United States Patent [19]

Gomes

[11] Patent Number: 4,958,425

[45] Date of Patent: Sep. 25, 1990

[54] KNOCK-DOWN FURNITURE COUPLING DEVICE

[76] Inventor: Daniel Gomes, P.O. Box 117, Worcester, N.Y. 12197

[21] Appl. No.: 191,897

[22] Filed: May 10, 1988

Related U.S. Application Data

[62] Division of Ser. No. 888,763, Jul. 22, 1986, Pat. No. 4,743,068.

[51] Int. Cl.[5] ..... B23P 19/04

[52] U.S. Cl. ..... 29/433; 52/473; 403/297; 411/392; 411/907

[58] Field of Search ..... 16/2, 3, DIG. 22; 52/222, 228, 667, 473; 403/292, 297, 408.1; 411/383, 392, 384, 907, 374, 397, 389; 29/433

[56] References Cited

U.S. PATENT DOCUMENTS 1,368,222 2/1921 Foreman ..... 52/227
2,779,729 1/1957 Jorgensen ..... 411/389 X

FOREIGN PATENT DOCUMENTS 2372982 8/1978 France ..... 52/227

*Primary Examiner*—Timothy V. Eley

[57] ABSTRACT

An article of knock-down furniture that can be easily assembled by an end-user comprises a plurality of pieces and contact joint arrangements that prevent unwanted separation of the pieces, while permitting the pieces to rotate and flex relative to each other. The contact joint arrangements also have lateral flexibility to permit the pieces to be coupled and shaped into a contour. The contact joint arrangement has a flexible tube that is extended through a continuous bore through each of the pieces. A hanger bolt is threaded into each end of the tube. A cap nut is threaded onto each hanger bolt and is in bearing contact with the end pieces. Each of the cap nuts are tightened against the end surface of the end pieces in order to place the tube in tension. The pieces are, consequently, held in longitudinal compression between the two cap nuts, while remaining free to rotate about the longitudinal axis of the tube. The hanger bolt and cap nut arrangement can be replaced by a screw assembly threaded into each end of the tube and contacting the end surfaces of the end pieces. The screw assembly in one end of the tube is threaded into the tube through a hole or notch cut hear the particular end of the tube. Once the screw assembly has been engaged through the hole or notch, the excess lead portion of the tube can be separated from the tube. Additionally, the screw assembly, or the hanger bolt and cap nut arrangement at one end of the flexible tube can be replaced by a restraining element situated in fixed relationship with the tube, such as a molded stop or a cotter pin inserted through a transverse hole in cut one end of the tube.

6 Claims, 4 Drawing Sheets

FIG. 3
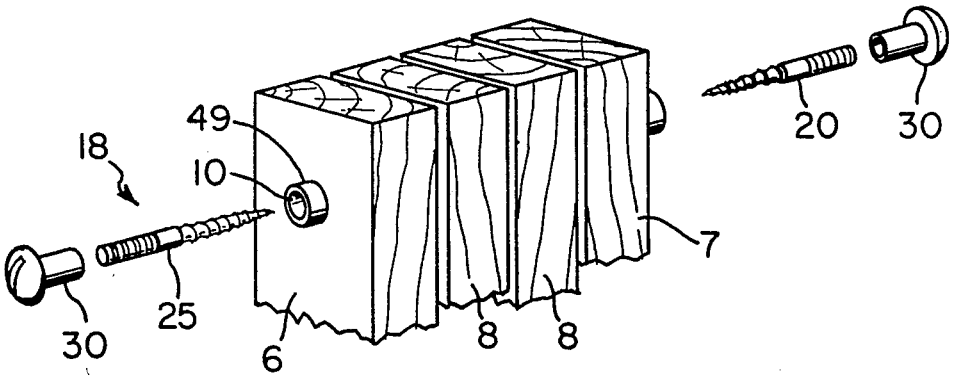
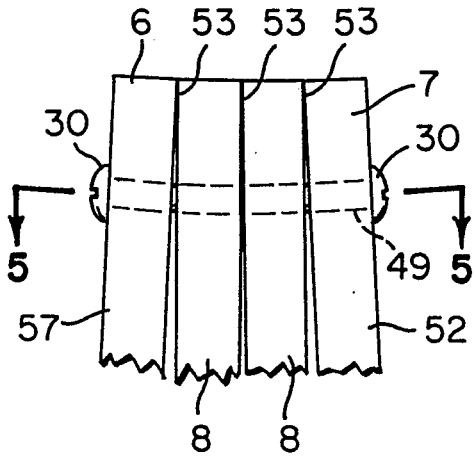
FIG. 4

KNOCK-DOWN FURNITURE COUPLING DEVICE

This application is a division, of application Ser. No. 888,763, filed Jul. 22, 1986 now U.S. Pat. No. 4,743,068.

BACKGROUND OF THE INVENTION

This invention relates to an article of knock-down furniture that can be easily assembled by the end-user.

Articles of furniture that consist of several pieces, each capable of rotation relative to each other, are well known. A typical example is the folding chair. One type of folding chair, known as "knock-down" furniture, has several pieces making up the seat, back and legs of the chair. In a typical design, each piece has a bore through which a metal rod is passed. Each piece is strung on this rod like beads on a string until the full complement of pieces has been reached to create a portion of the chair. The pieces are held in place on the rod by some fastening means at the ends of the rod. When the article of furniture is completely assembled, each portion of the chair is capable of rotation relative to each other, thereby allowing the knock-down chair to fold out into an open position for use, or to fold into a closed compact position suitable for storage.

When the article of furniture has some contour to its seat or back portions, the metal rod has been replaced by metal wire, such as 12 gauge fence wire. The flexibility of the wire allows it to conform to this contour. This transverse flexibility is necessary when the contoured article of furniture is folded into its closed position. The wire is typically bent at the ends and driven back into the end pieces. A knock-down chair of this design usually has to be assembled by the manufacturer because the procedure and tools required are beyond the means of the average consumer.

A common problem with most knock-down furniture items is that they are not designed to be easily assembled by the end-user. Pre-assembly of the furniture by the manufacturer is typically required, thereby increasing the production and shipping costs of the item. In addition, the end-user cannot easily adjust the pre-assembled furniture should the items become loose. This invention addresses these problems of ease of assembly, ease of adjustment and cost-effectiveness, by replacing the use of metal rod or metal wire to couple the pieces of an article of knock-down furniture.

SUMMARY OF THE INVENTION

Described briefly, in a typical embodiment of the present invention, a kit is comprised of a plurality of pieces that, when assembled, form an article of knock-down furniture. In the assembled configuration, the pieces are combined at a plurality of hinge arrangements, each hinge arrangement having a first and a second end piece and a selection of pieces sandwiched between these end pieces. An aligned bore extends through each of the plurality of pieces at each of the hinge arrangements. At each of the hinge arrangements a plastic tube is extended through each of the aligned bores. The tube has a length slightly shorter than the effective length of the aligned bore. A hanger bolt is threaded into each end of the plastic tube prior to assembly. A cap nut is threaded onto the exposed threads of each hanger bolt, once the plastic tube has been located within the aligned bore in each of the hinge arrangements. The cap nuts at each end of the plastic tube are in bearing contact with the end pieces, and are tightened against these end pieces in order to place the tube in tension. The furniture pieces are, consequently, held in longitudinal compression between the two cap nuts, while remaining free to rotate about the longitudinal axis of the tube. Each element of the particular article of knock-down furniture, e.g., the seat, back and legs in the case of a chair, is thus combined and interfaced using this tube assembly at each hinge arrangement in such a manner that the article of furniture is fully collapsible in a closed position, and extendable to its normally operative arrangement in an open position.

BRIEF DESCRIPTION OF THE DRAWINGS

FIG. 3 is an enlarged exploded view of a contact joint of the article of furniture of FIG. 1.

FIG. 4 is an enlarged front elevational view of the contact joint in FIG. 3, shown in the assembled configuration.

DESCRIPTION OF THE PREFERRED EMBODIMENT

Figure 1:
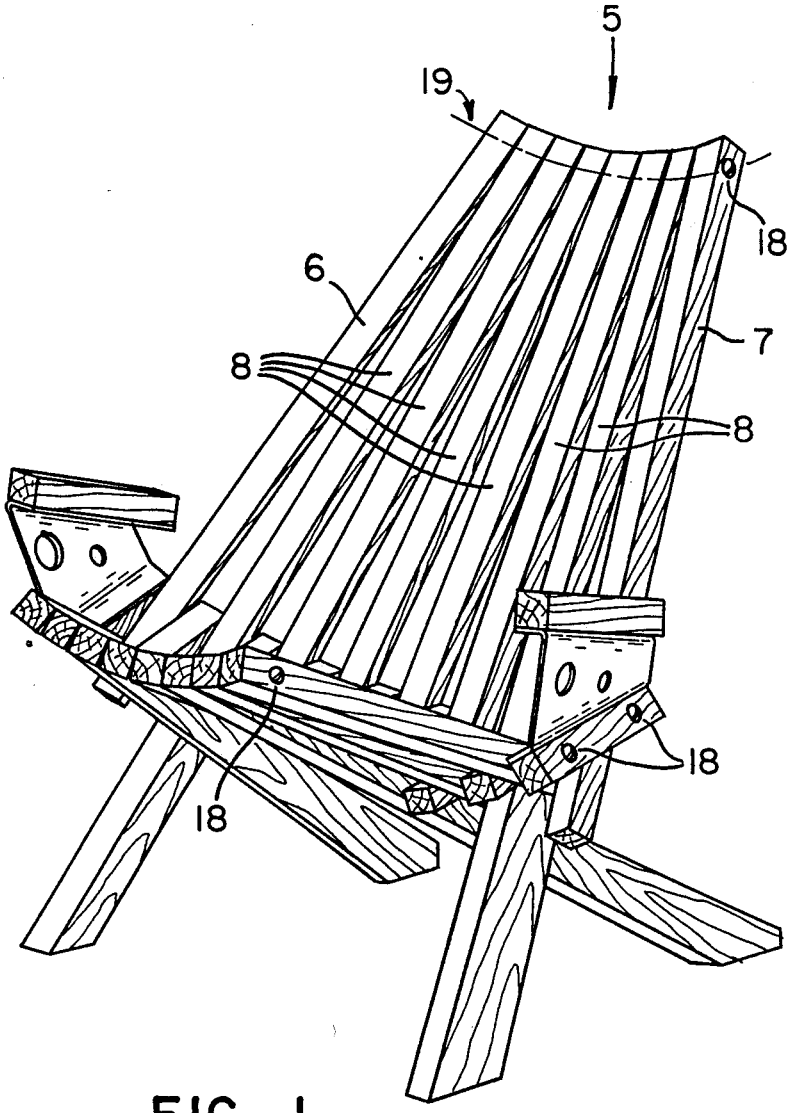
FIG. 1 is perspective view of an article of knock-down furniture embodying the present invention, shown in the open position.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further application of the principles of the invention as illustrated therein being comtemplated as would normally occur to one skilled in the art to which the invention relates.

Figure 2:
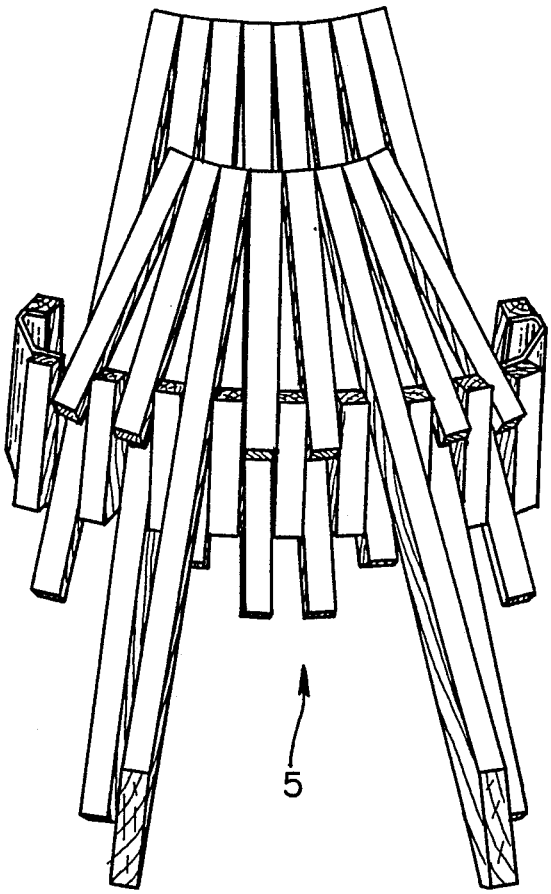
FIG. 2 is a perspective view of the article of furniture of FIG. 1, shown in the closed position.

In one embodiment of this invention, an article of knock-down furniture 5, shown in FIG. 1 in the assembled configuration, comprises a plurality of pieces 8. These pieces 8 are formed to constitute the elements of this article of furniture—namely, the legs, seat and back of the chair. The pieces are held in this configuration by a number of contact joint arrangements 18, each adjustably constrained against end pieces, such as pieces 6 and 7 in FIG. 1. Each contact joint arrangement is flexible to allow the pieces to be formed into a contour 19. In addition, the contact joint arrangement is designed to allow the pieces to rotate relative to each other so that the article of furniture 5 can be folded into a closed position, as shown in FIG. 2.

The basic elements of the contact joint arrangement are illustrated in the exploded view of FIG. 3. An aligned bore 49 extends through each of the pieces 6, 7 and 8. A flexible plastic tube 10 has hanger bolts 20 and 25 threaded into each end of the tube. The tube and hanger bolt assembly is passed through the bore 49. A cap nut 30 is threaded onto each hanger bolt 20 and 25 at each end of the tube. The cap nuts at each end are tightened against the outer surface 57 and 52 of the end pieces 6 and 7, respectively, as shown in FIG. 4. As the cap nuts are tightened, the tube 10 is placed in tension, which is reacted as a compressive force through the cap nuts 30 to restrain the pieces 6, 7 and 8. The pieces contact each other at joints 53. The contact joint arrangement can flex at these joints 53 to allow the pieces to assume a contour, or to change contour when the article of furniture is folded into its closed configuration. The amount of tension in the tube 10 determines the tautness of the contact joint arrangment and, consequently, the rigidity of the contour formed by the pieces 6, 7 and 8.

Figure 5:
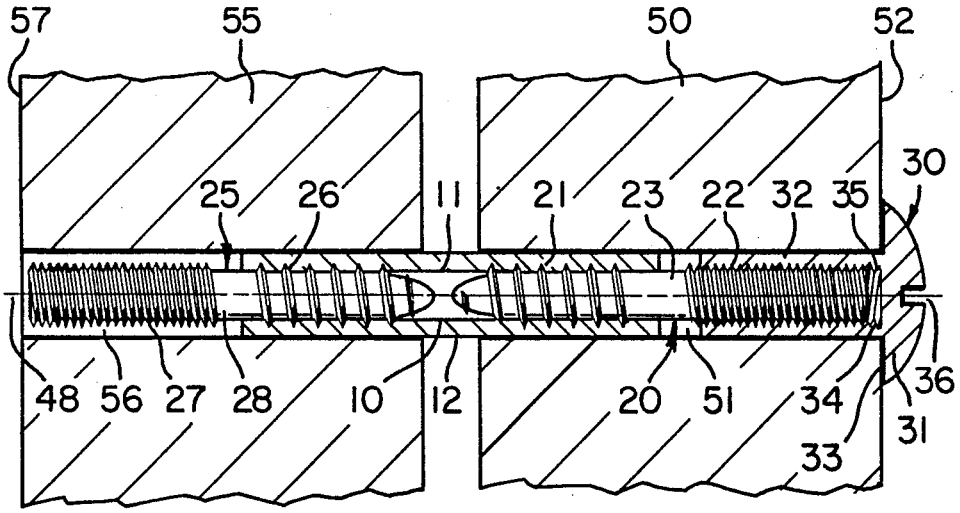
FIG. 5 is an enlarged cross-sectional view of a portion of the section 5—5 of FIG. 4, viewed in the direction of the arrows.

The details of the contact joint arrangement are shown in FIG. 5. For purposes of clarity, only a first end piece 50 and a second end piece 55 are shown, although it is understood that a number of similar pieces can be sandwiched between these end pieces in a final configuration. The pieces 50 and 55 each have a bore 51 and 56, respectively, with the central axis of the bores in alignment on a common axis 48 to form the common bore 49. In the present embodiment, the flexible tube 10 having an inner circumferential surface 11 and an outer surface 12, is cut to a length slightly shorter than the combined length of the common bore 49, so that the tube can be located fully within the combined bore when the pieces are strung together, as illustrated in FIG. 4.

Some means of restraining the tube within the bore is provided. Typically, a hanger bolt 20 is threaded into the inner surface 11 of the tube 10 prior to the tube being inserted into the common bore 49. The hanger bolt 20 has a first threaded section 21, in threaded engagement with the inner surface 11, a gripping section 23 to facilitate threading the first threaded section 21 into the tube 10, and a second threaded section 22. During installation, the bolt 20 is threaded into one end of the tube 10 leaving at least the second threaded section 22 exposed beyond the end of the tube. Similarly, another hanger bolt 25, having a first threaded section 26, a gripping section 28, and a second threaded section 27, is threaded into the inner surface 11 at the opposite end of the tube 10. Also, prior to the tube 10 being inserted into the common bore 49, some means is provided to constrain the hanger bolts 20 and 25 against the pieces 50 and 55, respectively. One preferred means has been a cap nut 30 threaded onto the second threaded section 22 of the hanger bolt 20. The cap nut 30 has a head portion 31 having a mounting surface 33, and a threaded portion 32 extending perpendicularly from the mounting surface 33. The mounting surface 33 has an effective diameter greater than the effective diameter of the common bore 49 so that the head portion cannot pass through the bore. The threaded portion 32 has an interior circumferential surface 34 with internal receiving threads 35 formed in the surface 34. The second threaded section 22 of the bolt 20 is, thus, in threaded engagement with these internal receiving threads when the cap nut 30 is threaded onto the hanger bolt 20. Any means to tighten the cap nut onto the hanger bolt is acceptable, however, the preferred method to date has been the provision of a screwdriver slot 36 in the head portion 31 of the cap nut 30 to receive a screwdriver for facilitating threading the cap nut 30 onto the hanger bolt 20.

During assembly, one end of the tube 10 is inserted into the common bore 49 until the mounting surface 33 of the cap nut 30 abuttingly engages the end outer surface 52 of the first piece 50. In this configuration, the opposite end of the tube, and particularly the second threaded section 27 of the hanger bolt 25, is near the end outer surface 57 of the second piece 55. A second cap nut 30 is then engaged with the hanger bolt 25 so that the second threaded section 27 is threaded into the receiving internal threads 35 of the threaded portion 32. This threaded engagement is tightened until the mounting surface 33 of the head portion 31 of the cap nut 30 is abuttingly engaged with the outer surface 57 of the second piece 55.

In this preferred embodiment, each cap nut 30 abutting the end outer surfaces 52 and 57 can be tightened onto the hanger bolts 20 and 25 using a screwdriver in the slot 36. As the cap nuts are tightened, the tube 10 is put into increasing longitudinal tension. This longitudinal tension holds the mounting surfaces 33 of the cap nuts against the end outer surfaces 52 and 57, consequently holding the first and second pieces 50 and 55 in compressed engagement. The longitudinal tension in the tube 10 holds the pieces together while permitting each piece to rotate about the longitudinal axis of the tube relative to the tube and relative to each other. The flexibility of the tube and the degree of tension put on it also allow the tube, and consequently the pieces, to assume a contour shape. It is understood that additional pieces, each having a bore, can be strung onto the tube between the first and second end pieces, and held in position by the longitudinal tension in the tube.

It is also understood that variations on this preferred embodiment are permissible, including the replacement of the hanger bolt 20 at one end of the flexible tube with some other restraining means for preventing the tube from pulling through the common bore 49. Such restraining means can comprise a stop molded into the end of the tube, the stop having an effective diameter larger than the effective diameter of the bore 49. The hanger bolt may also be replaced by a cotter pin inserted through a transverse bore cut in one end of the tube adjacent to the end outer surface 52. In a further variation on this embodiment, the tube 10 may be longer than the effective length of the common bore 49. During assembly, the tube is stretched within the bore, a notch or a hole is cut in the tube adjacent to the end outer surface 52, and a hanger bolt and cap nut are inserted therein. The excess tube can be severed and discarded.

A beneficial feature of this invention is that this article of knock-down furniture 5 and the contact joint assembly 18 herein described are not complicated and do not require special tools or procedures to assemble. Thus, the end-user consumer can easily assemble an entire article of knock-down furniture in a short period of time. Further, the contact joint assembly in the preferred embodiment of the present invention allows adjustment of the tension in the tube so that as the tube stretches after several uses the resulting slack in the tube can be eliminated. Another benefit of the present embodiment is that the article of furniture can be just as easily disassembled.

The material of the flexible tubing can be any material having high-strength and flexibility characteristics. The tube msut have sufficient tensile strength to withstand the tension under which it operates. It must have sufficient flexural strength to endure periodic flexing as the furniture is opened and closed or subject to external loads. For this embodiment, the tubing must also be capable of receiving and retaining threads. The flexible tubing can be a high-strength nylon tubing of the type produced by The Polymer Corporation under the mark Nylaflow. For example, in applicant's preferred work to date, the tube has an outer diameter of ¼ inch and an inner diameter of ⅛ inch. Each hanger bolt is of a type commercially available at most hardware stores and is 1 ½ inches long and has a diameter of 3/16 inch, slightly larger than the inner diameter of the flexible tube so that the hanger bolt can cut threads into the tube when assembled. The hanger bolt is threaded into the tube so that about ½ inches of the second threaded portion is exposed beyond the tube. The cap nut is also commercially available and has a threaded portion ⅝ inches long with an outer diameter of ¼ inch and an inner thread diameter of 3/16 inch to receive the 3/16 inch diameter threads of the hanger bolt. The mounting surface of the head portion of the cap nut has a diameter of ½ inch, thus the common bore in the first and second pieces must have a diameter between ¼ and ½ inch in order to receive the cap nut threaded portion without having the cap nut fall into the common bore.

Figure 6:
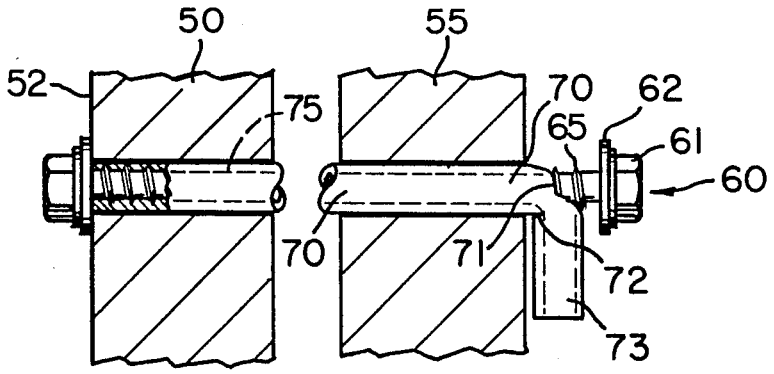
FIG. 6 is an enlarged cross-sectional view of a portion of a second embodiment of the present invention showing one end of the means for coupling a plurality of pieces in the assembled position and another end in the unassembled configuration.

In another embodiment of the present invention, the first and second pieces 50 and 55 each have a bore 51 and 56, respectively, and are abutted as previously described to form a common bore 49. A flexible tube 70 has a hole or a rounded notch 71 cut near one end of the tube and extending substantially through the tube to a tear segment 72, as shown in FIG. 6. It is understood that this notch can be cut into the tube prior to or after the tube 70 has been inserted into the common bore 49. An excess lead portion 73 is extended from the notch 71 to the end of the tube 70. The tube is of sufficient length so that the excess lead portion 73 extends beyond the common bore 49 when the remainder of the tube is fully within the common bore. A screw assembly 60 is threaded into the interior circumferential surface 75 of the tube 70 at the end opposite the end with the notch 71. The screw assembly 60 comprises a typical sheet metal screw 61 extending through a washer 62. The washer 62 has an effective diameter greater than the effective diameter of the common bore 49 to prevent the screw assembly 60 from passing through the common bore. The metal screw has a threaded portion 65 that is threaded into the tube.

The end of the tube 70 having the notch 71 is extended through the common bore 49 until the washer 62 abuts the end outer surface 52 of the first piece 50. In this position, the notch 71 and tear segment 72 will be slightly recessed within the common bore 49, while the excess lead portion 73 will extend beyond the end outer surface 57 of the second piece 55. The lead portion 73 is pulled until the hollow tube 70 is taut. A second screw assembly 60 is inserted through the notch 71 and threaded into the inner circumferential surface 75 of the tube 70, as shown in FIG. 6. The lead portion 73 is held against the end outer surface 57 while the screw assembly is inserted in order to prevent rotation of the tube 70 while the screw assembly is threaded into the inner circumferential surface 75. The threaded portion 65 of the sheet metal screw 61 is threaded into the tube until the washer 62 abuts the end outer surface 57 of the second piece 55. The tear segment 72 and a portion of the excess lead portion is pinched between the washer 61 and the end outer surface 57. The excess lead portion 73 is separated from the tube 70 at the tear segment 72 so that no piece of the tube projects beyond the washer 61 and the remainder of the tube 70 is contained within the common bore 49. The screw assembly 60 in either end of the tube is tightened to place the tube in longitudinal tension. At this point, this second embodiment has functional features substantially similar to those previously described in connection with the first embodiment.

Each of the embodiments of the present invention herein described represent a new and useful means for coupling two or more pieces in an article of knock-down furniture. Each is inexpensive and easy to understand and assemble by an end-user consumer. The components of the assembly, namely the flexible tube, hanger bolts, cap nuts, or, alternatively, the sheet metal screws and washers, are all commercially available in most hardware stores.

While the inventions have been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What I claim is:

1. An assembly for coupling a plurality of pieces, comprising:

an aligned bore extending through each of said plurality of pieces, said plurality of pieces comprising at least a first end piece and a second end piece:

an axially stretchable tube made from an elastomeric material, said tube having an interior surface at least partially therethrough, passing through said aligned bore; and means for removably securing said stretchable tube to, an in axial tension between, each of said first and second end pieces, thereby holding each of said pieces in a fixed longitudinal relationship, while permitting relative rotation between each of the said plurality of pieces.

2. The assembly of claim 1, wherein said means for removably securing said tube comprises:

threaded fastener means having a threaded portion and a head portion;

said head portion having an effective diameter larger than the effective diameter of said aligned bore such that the head portion cannot pass through said bore;

said threaded portion having a first threaded portion, said first threaded section being engaged with the interior surface of one end of said tube: and wherein rotation of either portion of said fastener means will cause a change in the axial length of said tube.

3. The assembly of claim 2, wherein said threaded fastener means further comprises:

said threaded portion being separable from said head portion;

the head portion having a bore with longitudinally extending receiving threads on the interior surface of said bore;

the threaded portion having a second threaded section extending beyond the end of said member when the threaded portion is engaged therein, said second threaded section being engaged with said receiving threads to removably secure the threaded portion to the head portion; and the engagement of the second threaded section and the receiving threads is sufficient to permit variation in the axial tension in the member when the assembly is complete.

4. The assembly of claim 3, wherein said engagement of the second threaded section and the receiving threads is situated substantially within said aligned bore without extending beyond the outer surface of said end piece.

5. The assembly of claim 1 wherein said stretchable tube is made of nylon.

6. The assembly of claim 1 wherein the length of said tube can be increased by said securing means acting on said tube.

* * * * *